US006419595B1

(12) United States Patent
Maruko et al.

(10) Patent No.: US 6,419,595 B1
(45) **Date of Patent: *Jul. 16, 2002**

(54) SOLID GOLF BALL

(75) Inventors: Takashi Maruko; Hisashi Yamagishi; Yutaka Masutani, all of Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 90 days.

This patent is subject to a terminal disclaimer.

(21) Appl. No.: 09/613,424

(22) Filed: Jul. 10, 2000

Related U.S. Application Data

(60) Provisional application No. 60/150,523, filed on Aug. 25, 1999.

(30) Foreign Application Priority Data

Jul. 9, 1999 (JP) ..... 11-195161

(51) Int. Cl.[7] ..... A63B 37/06
(52) U.S. Cl. ..... 473/376; 473/371
(58) Field of Search ..... 473/376, 373, 473/374, 377, 378, 367, 368, 371

(56) References Cited

U.S. PATENT DOCUMENTS 5,730,665 A * 3/1998 Shimosaka et al. ..... 473/376
5,816,937 A * 10/1998 Shimosaka et al. ..... 473/354
5,919,100 A * 7/1999 Boehm et al. ..... 473/354
6,068,561 A * 5/2000 Renard et al. ..... 473/364
6,117,025 A * 9/2000 Sullivan ..... 473/373
6,159,110 A * 12/2000 Sullivan et al. ..... 473/374
6,162,134 A * 12/2000 Sullivan et al. ..... 473/373
6,204,331 B1 * 3/2001 Sullivan et al. ..... 473/372
6,302,808 B1 * 10/2001 Dalton et al. ..... 473/371

FOREIGN PATENT DOCUMENTS

| | | |
|---|---|---|
| JP | 8-336617 | 12/1996 |
| JP | 8-336618 | 12/1996 |
| JP | 9-56848 | 3/1997 |
| JP | 9-299510 | 11/1997 |
| JP | 11-417 | 1/1999 |
| JP | 11-4916 | 1/1999 |

* cited by examiner

*Primary Examiner*—Mark S. Graham
*Assistant Examiner*—Raeann Gorden
(74) *Attorney, Agent, or Firm*—Sughrue Mion, PLLC

(57) ABSTRACT

A multilayer solid golf ball comprising a core and a cover of four layers is characterized in that a first layer of the cover enclosing the core has a Shore D hardness of up to 60, a second layer of the cover enclosing the first layer has a Shore D hardness of at least 45, a third layer of the cover enclosing the second layer has a Shore D hardness of up to 45, the second layer is made harder than the first layer, and a fourth layer of the cover enclosing the third layer is made harder than the third layer.

5 Claims, 1 Drawing Sheet

SOLID GOLF BALL

CROSS REFERENCE TO RELATED APPLICATION

This application is an application filed under 35 U.S.C. §111(a) claiming benefit pursuant to 35 U.S.C §119(e)(i) of the filing date of the Provisional Application 60/150,523 filed on Aug. 25, 1999 pursuant to 35 U.S.C. §111(b).

BACKGROUND OF THE INVENTION

1. Field of the Invention

This invention relates to a multilayer structure solid golf ball comprising a core and a cover of at least four layers formed therearound.

2. Related Art

The solid golf ball structures which have heretofore been proposed include multilayer structure solid golf balls comprising a core and a cover which are of multiple layers (see JP-A 8-336617, 8-336618, 9-56848, 9-299510, 11-417, and 11-4916).

One of the purposes of increasing the number of layers in solid golf balls is to obtain a feel equivalent to that of wound golf balls and another is to increase flight distance. In most cases, however, it often occurs that a preference for the feel leads to an unsatisfactory flight distance whereas the satisfaction of flight distance leads to a poor feel. Also, most prior art proposals mainly target golf players with a high head speed capability. Thus, there is a desire to have a golf ball which offers a satisfactory flight distance and a pleasant feel even when hit at low head speeds.

SUMMARY OF THE INVENTION

An object of the present invention is to provide a multilayer solid golf ball which offers a satisfactory flight distance and a pleasant feel not only when hit at high head speeds, but also when hit at low head speeds.

To achieve this and other objects, the present invention provides a golf ball as defined below.

(1) A multilayer solid golf ball comprising a core and a cover of four layers, characterized in that a first layer of the cover enclosing the core has a Shore D hardness of up to 60, a second layer of the cover enclosing the first layer has a Shore D hardness of at least 45, a third layer of the cover enclosing the second layer has a Shore D hardness of up to 45, the second layer is made harder than the first layer, and a fourth layer of the cover enclosing the third layer is made harder than the third layer.

(2) The solid golf ball of (1) wherein the first and third layers of the cover each have a Shore D hardness of 10 to 45, and the second layer of the cover has a Shore D hardness of 45 to 70.

(3) The solid golf ball of (1) or (2) wherein the core has a diameter of 26 to 35 mm, the core at its surface has a Shore D hardness of at least 40, and the fourth layer of the cover has a thickness of 0.5 to 3.0 mm.

(4) The solid golf ball of any one of (1) to (3) wherein the first and third layers of the cover each are formed of at least one member selected from the group consisting of polyester resins, polyurethane resins, and thermoplastic polyamide elastomers.

(5) The solid golf ball of any one of (1) to (4) wherein the fourth layer of the cover is formed of an ionomer resin.

Making extensive investigations in the light of the above object, the inventor has found that the sandwich structure of hard and soft layered cover can be doubled by forming a cover from the above-described four layers. In this case, the soft cover layer sandwiched between hard cover layers, because of restraint at its interface with the hard cover layer, exhibits a hard material-like behavior despite a soft material so that the amount of deformation is optimized. Consequently, there is obtained a ball which is highly resilient although it is soft. In addition, the use of two soft layers in the cover contributes to a pleasant feel and even optimized spin properties.

DETAILED DESCRIPTION OF THE INVENTION

Figure 1:
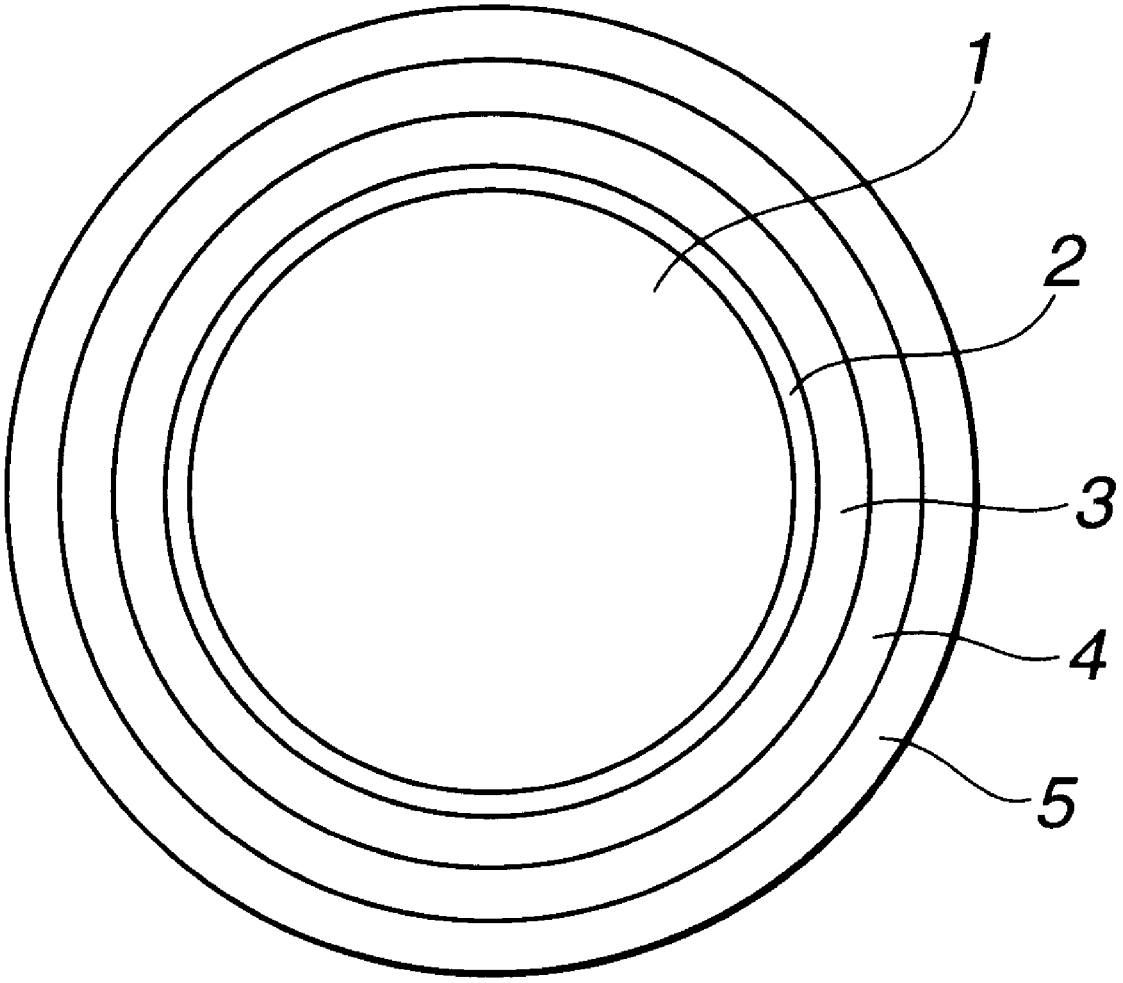
FIG. 1 is a cross-sectional view of one embodiment of the invention.

The golf ball of the invention has a core of at least one layer and a cover of four layers. As shown in FIG. 1, a first layer 2 of the cover is formed around a core 1, and a second layer 3, a third layer 4, and a fourth layer 5 of the cover are successively formed so as to enclose the preceding layer.

The core may be formed to a diameter of at least 26 mm, especially at least 29 mm and up to 35 mm, especially up to 33.5 mm.

The core may be formed of a rubber composition, a thermoplastic resin or a mixture thereof. The rubber composition used herein may be any well-known composition although a composition using polybutadiene as the base is preferable. As the polybutadiene, 1,4-cis polybutadiene containing at least 40% of cis-structure is preferably used. In the base rubber, natural rubber, polyisoprene rubber or styrene-butadiene rubber may be properly blended with the polybutadiene if desired. The golf ball can be improved in resilience by increasing the content of rubber component.

In the rubber composition, there may be blended a crosslinking agent, for example, zinc and magnesium salts of unsaturated fatty acids such as zinc methacrylate and zinc diacrylate, and esters such as trimethylpropane methacrylate. Of these, zinc diacrylate is preferably used. An appropriate amount of the crosslinking agent blended is 10 to 30 parts by weight per 100 parts by weight of the base rubber.

In the rubber composition, a vulcanizing agent is usually blended. Peroxides, typically organic peroxides are preferred vulcanizing agents. Such peroxides are commercially available, for example, as Percumyl D and Perhexa 3M from Nippon Oil and Fats K.K. The amount of the vulcanizing agent blended may be 0.6 to 2 parts by weight per 100 parts by weight of the base rubber.

Moreover, an antioxidant and a filler for specific gravity adjustment such as zinc oxide or barium sulfate are blended if necessary.

Preferably the core at its surface has a Shore D hardness of at least 40, more preferably at least 45, most preferably at least 49, and up to 65, more preferably up to 63. It is further preferable that the core is harder than the cover first layer to be described later.

The core used herein may be formed to a multilayer structure of at least two layers. In one exemplary construction, the innermost core is formed of a rubber composition and an outer core is formed around the innermost core from a thermoplastic resin such as an ionomer resin. The outer core has a Shore D hardness in the above range.

Preferably the first to fourth layers of the cover each are separately formed of thermoplastic resins although they may also be formed of rubber base materials. Exemplary thermoplastic resins include polyurethane resins (thermoplastic polyurethane elastomers), polyester resins (thermoplastic polyester elastomers), thermoplastic polyamide elastomers, and ionomer resins. Commercially available products are Pandex (thermoplastic polyurethane elastomers by Dai-Nippon Ink and Chemicals K.K.), Hytrel (thermoplastic polyester elastomers by Toray-Dupont K.K.), Surlyn (ionomer resins by Dupont), Himilan (ionomer resins by Mitsui-Dupont Polychemical K.K.), Rilsan (polyamide resins by Elf Atochem), and Pebax (thermoplastic polyamide elastomers by Elf Atochem).

The cover first layer is formed to a Shore D hardness of up to 60, preferably up to 55, and more preferably up to 45. For the first layer, the lower limit of Shore D hardness is preferably at least 10, more preferably at least 20, and most preferably at least 25. A too high Shore D hardness leads to the disadvantage that no soft feel is obtainable.

The cover first layer is preferably formed of a polyester resin, polyurethane resin, thermoplastic polyamide elastomer or a mixture thereof. An ionomer resin may be admixed therewith if desired.

The cover first layer preferably has a thickness of at least 0.5 mm, more preferably at least 0.8 mm and most preferably at least 1.0 mm and up to 4.0 mm, more preferably up to 3.0 mm, and most preferably up to 2.5 mm.

Next, the cover second layer is formed to a Shore D hardness of at least 45, preferably at least 55, and more preferably at least 60, and harder than the cover first layer. If the second layer is softer than the first layer or softer than the above-defined value, its effect of restraining the first layer is not fully exerted, leading to an undesirable loss of resilience. The upper limit of the Shore D hardness of the second layer is preferably up to 70, especially up to 65.

The cover second layer may be formed of any thermoplastic resin as long as it imparts the above-described hardness. It is preferred to use ionomer resins, especially high acid ionomer resins.

The cover second layer preferably has a thickness of at least 0.5 mm, more preferably at least 0.8 mm and most preferably at least 1.0 mm and up to 4.0 mm, more preferably up to 3.0 mm, and most preferably up to 2.5 mm.

The cover third layer is formed to a Shore D hardness of up to 45, preferably up to 40. For the third layer, the lower limit of Shore D hardness is preferably at least 10, more preferably at least 20, and most preferably at least 25. Also, the third layer is made softer than the second layer and softer than the fourth layer to be described later. If the third layer has a Shore D hardness in excess of 45, there arises the disadvantage that no soft feel is obtainable.

Like the cover first layer, the cover third layer is preferably formed of a polyester resin, polyurethane resin, thermoplastic polyamide elastomer or a mixture thereof. An ionomer resin may be admixed therewith if desired.

The cover third layer preferably has a thickness of at least 0.5 mm, more preferably at least 0.8 mm and most preferably at least 1.0 mm and up to 4.0 mm, more preferably up to 3.0 mm, and most preferably up to 2.5 mm.

The cover fourth layer should be made harder than the cover third layer. If the fourth layer is softer than the third layer, the object of the invention is not attainable. Preferably, the cover fourth layer has a Shore D hardness of at least 45, more preferably at least 50, and most preferably at least 55, and up to 70, more preferably up to 65.

The material of which the cover fourth layer is formed is not critical although it is preferably formed of ionomer resins.

The cover fourth layer preferably has a thickness of at least 0.5 mm, more preferably at least 0.8 mm and most preferably at least 1.0 mm and up to 3.0 mm, more preferably up to 2.5 mm.

According to the invention, the hardness distribution throughout the core and the first to fourth layers of the cover is as described above. When the cover second layer has the highest hardness among these, the control and feel are more improved.

Understandably, the first to fourth layers of the cover are preferably formed of thermoplastic resins as previously described while it is optional to blend inorganic fillers therein for the purpose of specific gravity adjustment and add other suitable additives thereto.

Like conventional golf balls, the golf ball of the invention may be formed with 300 to 600 dimples in a well-known arrangement.

Understandably, the diameter and weight of the golf ball of the invention comply with the Rules of Golf. The ball may be formed to a diameter of not less than 42.67 mm, and especially from 42.67 mm to 42.75 mm and a weight of not greater than 45.93 g, and especially from 45.90 g to 45.10 g.

The golf ball of the invention offers a satisfactory flight distance performance regardless of whether the head speed is high or low and especially, achieves a flight distance improvement and a pleasant feel even when hit at low head speeds.

EXAMPLE

Examples and Comparative Examples are given below for illustrating the invention although the invention is not limited to the Examples.

Examples & Comparative Examples

Using the rubber formulation shown in Table 1 and the resin blend shown in Table 2, five-piece solid golf balls were prepared as shown in Table 3 and examined for flight performance and feel by the following methods. The results are shown in Table 3.

Flight Performance

Using a swing robot, the ball was hit with a driver at a head speed of 45 m/sec and 35 m/sec. An initial velocity, carry and total distance were measured.

Feel

Three professional golfers actually hit the ball for evaluation.

◎: very good

○: good

Δ: ordinary

×: poor

TABLE 1

| Rubber composition (pbw) | Rubber A | Rubber B | Rubber C | Rubber D | Rubber E | Rubber F | Rubber G | Rubber H | Rubber I | Rubber J |
|---|---|---|---|---|---|---|---|---|---|---|
| JSR BR01 | 100.0 | 100.0 | 100.0 | 100.0 | 100.0 | 100.0 | 100.0 | 100.0 | 100.0 | 100.0 |
| Zinc diacrylate | 25.0 | 30.0 | 35.0 | 30.0 | 35.0 | 28.0 | 25.0 | 18.5 | 18.0 | 34.0 |
| Zinc oxide | 32.3 | 30.5 | 32.1 | 35.7 | 26.9 | 10.0 | 30.7 | 41.4 | 59.0 | 7.0 |
| Nocrack NS-6 | 0.2 | 0.2 | 0.2 | 0.2 | 0.2 | 0.5 | 0.2 | 0.2 | 0.5 | 0.5 |
| Dicumyl peroxide | 1.0 | 1.0 | 1.0 | 1.0 | 1.0 | 1.5 | 1.0 | 1.0 | 1.5 | 0.5 |

* Vulcanizing Conditions
Core: 155° C. 15 min
Inner and intermediate layers: 130° C. 10 min (semi-vulcanization)→155° C. 15 min (full vulcanization)

TABLE 2

| Resin composition (pbw) | Resin A Ionomer | Resin B Ionomer | Resin C Ionomer | Resin D Ionomer | Resin E Ionomer | Resin F Polyester | Resin G Polyester | Resin H Polyester | Resin I Poly-urethane | Resin J Polyamide elastomer |
|---|---|---|---|---|---|---|---|---|---|---|
| Himilan AM7315 | 50 | | | | | | | | | |
| Himilan AM7318 | 50 | | | | | | | | | |
| Himilan 1605 | | 50 | 50 | 50 | | | | | | 30 |
| Himilan 1706 | | 50 | | | | | | | | |
| Himilan 1557 | | | 25 | | 30 | | | | | |
| Himilan 1554 | | | 25 | 50 | | | | | | |
| Surlyn 8120 | | | | | 70 | | | | | |
| Hytrel 3078 | | | | | | 100 | | | | |
| Hytrel 4047 | | | | | | | 100 | | | |
| Hytrel 4767 | | | | | | | | 100 | | |
| Pandex T-2198 | | | | | | | | | 100 | |
| Pebax 2533 | | | | | | | | | | 70 |

TABLE 3

| | Example | | | | | Comparative Example | | |
|---|---|---|---|---|---|---|---|---|
| | 1 | 2 | 3 | 4 | 5 | 1 | 2 | 3 |
| Core | | | | | | | | |
| Material | Rubber A | Rubber B | Rubber C | Rubber D | Rubber E | Rubber F | Rubber G | Rubber H |
| Diameter (mm) | 32.7 | 30.7 | 29.2 | 29.2 | 26.7 | 25.0 | 35.1 | 30.9 |
| Weight (g) | 22.5 | 18.9 | 16.6 | 16.4 | 12.2 | 9.0 | 27.6 | 19.6 |
| Shore D at surface | 49 | 56 | 62 | 56 | 62 | 52 | 49 | 35 |
| Cover 1st layer | | | | | | | | |
| Material | Resin F | Resin G | Resin G | Resin I | Resin G | Rubber I | Resin A | Resin C |
| Diameter (mm) | 34.7 | 34.7 | 32.7 | 32.2 | 30.7 | 31.5 | 37.3 | 35.3 |
| Thickness (mm) | 1.0 | 2.0 | 1.75 | 1.5 | 2.0 | 3.25 | 1.1 | 2.2 |
| Weight (g) | 26.4 | 26.2 | 22.2 | 21.8 | 18.0 | 20.2 | 32.0 | 27.0 |
| Shore D | 30 | 40 | 40 | 53 | 40 | 31 | 68 | 62 |
| Cover 2nd layer | | | | | | | | |
| Material | Resin A | Resin B | Resin B | Resin B | Resin H | Rubber J | Resin E | Resin G |
| Diameter (mm) | 36.7 | 36.7 | 34.7 | 34.7 | 34.7 | 36.5 | 39.9 | 38.7 |
| Thickness (mm) | 1.0 | 1.0 | 1.0 | 1.25 | 2.0 | 2.5 | 1.3 | 1.7 |
| Weight (g) | 30.3 | 30.19 | 25.71 | 26.02 | 25.70 | 30.23 | 37.92 | 35.17 |
| Shore D | 68 | 65 | 65 | 65 | 47 | 43 | 47 | 40 |
| Cover 3rd layer | | | | | | | | |
| Material | Resin F | Resin F | Resin G | Resin F | Resin J | Resin J | — | — |
| Diameter (mm) | 38.7 | 39.7 | 38.7 | 38.7 | 38.7 | 39.0 | — | — |
| Thickness | 1.0 | 1.5 | 2.0 | 2.0 | 2.0 | 1.25 | — | — |

TABLE 3-continued

| | Example | | | | | Comparative Example | | |
|---|---|---|---|---|---|---|---|---|
| | 1 | 2 | 3 | 4 | 5 | 1 | 2 | 3 |
| (mm) | | | | | | | | |
| Weight (g) | 35.1 | 37.5 | 35.2 | 35.2 | 35.2 | 35.8 | — | — |
| Shore D | 30 | 30 | 40 | 30 | 41 | 41 | — | — |
| Cover 4th layer | | | | | | | | |
| Material | Resin B | Resin C | Resin D | Resin C | Resin D | Resin A | Resin A | Resin B |
| Diameter (mm) | 42.7 | 42.7 | 42.7 | 42.7 | 42.7 | 42.7 | 42.7 | 42.7 |
| Thickness (mm) | 2.0 | 1.5 | 2.0 | 2.0 | 2.0 | 1.85 | 1.4 | 2.0 |
| Weight (g) | 45.19 | 45.28 | 45.30 | 45.28 | 45.29 | 45.19 | 45.20 | 45.27 |
| Shore D | 65 | 62 | 58 | 62 | 58 | 68 | 68 | 65 |
| Flight performance HS 45 m/sec W#1 | | | | | | | | |
| Initial velocity (m/sec) | 67.0 | 66.8 | 66.8 | 66.6 | 66.5 | 66.4 | 66.3 | 66.3 |
| Carry (m) | 217.2 | 215.8 | 216.4 | 215.5 | 213.7 | 211.7 | 210.8 | 211.4 |
| Total (m) | 233.8 | 231.5 | 232.9 | 231.1 | 229.5 | 226.7 | 224.9 | 225.8 |
| Flight performance HS 35 m/sec W#1 | | | | | | | | |
| Initial velocity (m/sec) | 50.2 | 50.0 | 50.0 | 49.8 | 49.7 | 49.6 | 49.4 | 49.5 |
| Carry (m) | 148.4 | 147.9 | 147.5 | 146.1 | 145.0 | 143.5 | 142.3 | 143.2 |
| Total (m) | 160.7 | 160.6 | 159.8 | 158.5 | 157.5 | 155.9 | 155.0 | 155.3 |
| Feel | ○ | ◎ | ◎ | ◎ | ○ | Δ | x | Δ |

What is claimed is:

1. A multilayer solid golf ball comprising a core and a cover of four layers, characterized in that a first layer of the cover enclosing the core has a Shore D hardness of up to 60, a second layer of the cover enclosing the first layer has a Shore D hardness of at least 45, a third layer of the cover enclosing the second layer has a Shore D hardness of up to 45, the second layer is made harder than the first layer, and a fourth layer of the cover enclosing the third layer is made harder than the third layer.

2. The solid golf ball of claim 1 wherein the first and third layers of the cover each have a Shore D hardness of 10 to 45, and the second layer of the cover has a Shore D hardness of 45 to 70.

3. The solid golf ball of claim 1 wherein the core has a diameter of 26 to 35 mm, the core at its surface has a Shore D hardness of at least 40, and the fourth layer of the cover has a thickness of 0.5 to 3.0 mm.

4. The solid golf ball of claim 1 wherein the first and third layers of the cover each is formed of at least one member selected from the group consisting of polyester resins, polyurethane resins, and thermoplastic polyamide elastomers.

5. The solid golf ball of claim 1 wherein the fourth layer of the cover is formed of an ionomer resin.

* * * * *